United States Patent [19]

Lippman

[11] Patent Number: 4,794,390

[45] Date of Patent: Dec. 27, 1988

[54] ALPHANUMERIC DISPLAY MEANS

[76] Inventor: Jeffrey H. Lippman, 263 Camino Norte, Chico, Calif. 95926

[21] Appl. No.: 842,420

[22] Filed: Mar. 10, 1986

[51] Int. Cl.[4] ..... G09G 3/04

[52] U.S. Cl. ..... 340/756; 340/762; 40/452

[58] Field of Search ..... 340/756, 757, 758, 759, 340/760, 761, 762, 763, 764, 765; 313/513, 514, 515, 516, 517, 518, 519, 520, 521, 522, 510, 500; 40/450, 451, 452, 550, 551, 552

[56] References Cited

U.S. PATENT DOCUMENTS 4,323,893 4/1982 Ypsilantis et al. ..... 340/756

FOREIGN PATENT DOCUMENTS 0955922 1/1950 France ..... 40/452
0114996 9/1979 Japan ..... 340/756
0523192 7/1940 United Kingdom ..... 40/452
2052825 1/1981 United Kingdom ..... 340/756
2071386 9/1981 United Kingdom ..... 40/452

*Primary Examiner*—John W. Caldwell, Sr.
*Assistant Examiner*—Alvin Oberley
*Attorney, Agent, or Firm*—Mark C. Jacobs

[57] ABSTRACT

An alphanumeric display including an array of 42 electrically energizable, light-emitting or reflecting segments which, when selectively energized, are capable of forming legibly all numerals and upper and lower case alphabet letters and/or mathematical and punctuation symbols. The array disclosed is characterized by arrangement of the light-emitting or reflecting elements in closely nested relation to form a vertically disposed rectangular display. A solid state system employing the display means including light-emitting diodes and switching transistors is disclosed.

11 Claims, 6 Drawing Sheets

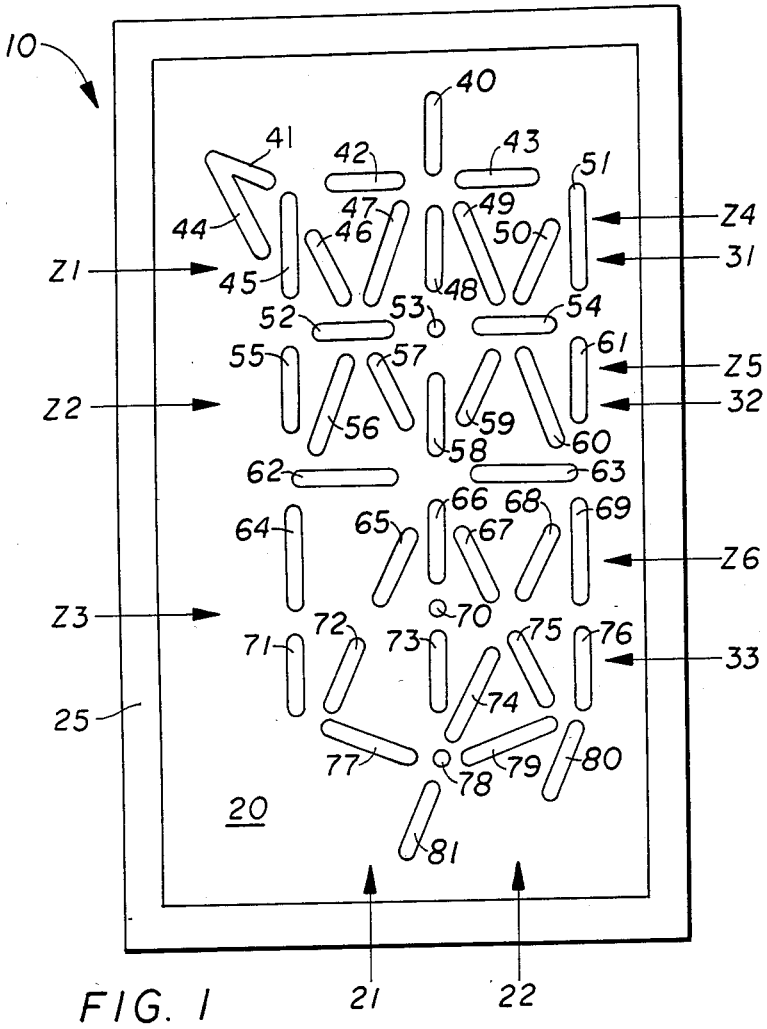
FIG. 1
FIG. 2
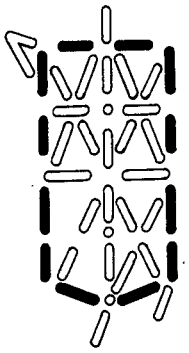
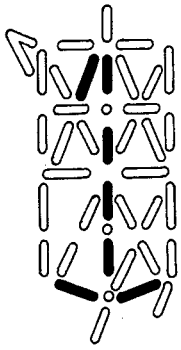
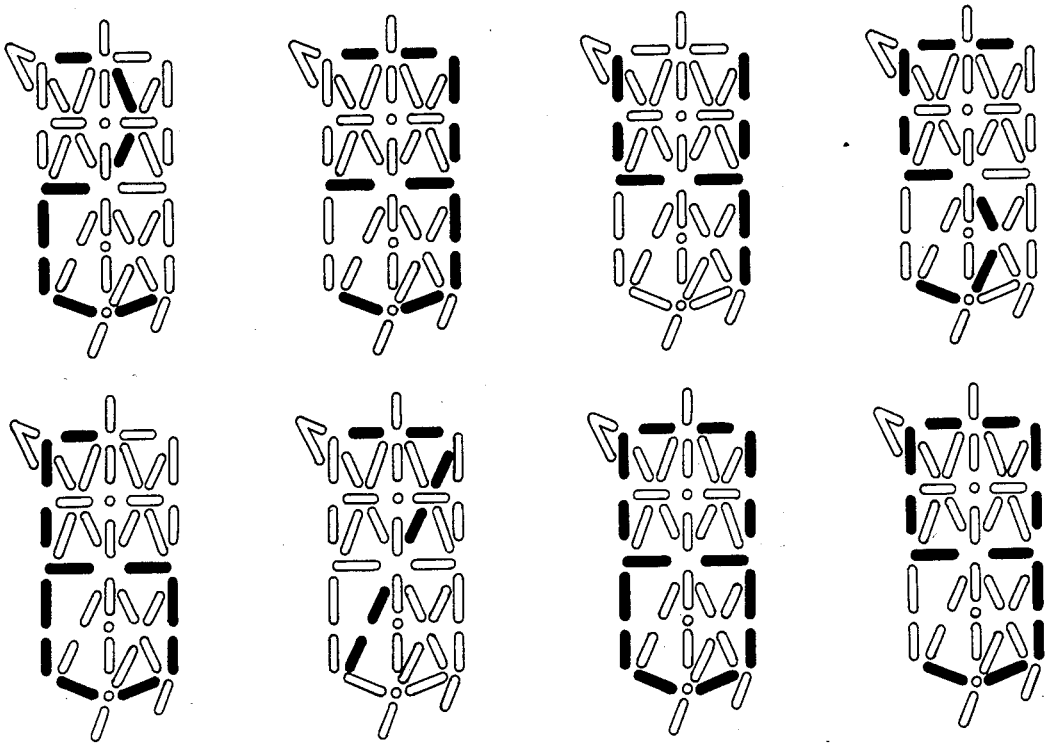

ALPHANUMERIC DISPLAY MEANS

FIELD OF THE INVENTION

This invention pertains to electrically energizable displays useable for mass communication signs, computer displays and the like.

BACKGROUND OF THE INVENTION

This invention relates to flat display systems and, more particularly, to a alphanumeric display means, which permits versatile display of readily discernible indicia.

Heretofore, various types of display systems have been known. In one type, independent light emitting elements are arranged in a planar form as in lamp display boards and luminescent diode display systems. In another type of system, a luminescent material is sandwiched between two electrode plates and activated by application of an electric field, as in electroluminescence display systems and plasma display systems. In a further type, a material capable of undergoing changes of light transmitting character, light absorbing character and other optical characteristics by application of electric field is sandwiched between two electrode plates, as in liquid crystal electro-optical display systems, photo-chromic material display systems and cataphoresis display systems.

These systems have been employed for the illustration of various indicia. Some of these are alphanumeric systems.

Among the alphanumeric displays known to applicant are those of Hurata in U.S. Pat. No. 3,936,816 and Lapeyre, U.S. Pat. No. R.E. 29,033.

Of these Hurata requires 96 pattern elements to display the alphanumeric characters and other usually employed symbols (punctuation) in a readily discernible form. Lapeyre on the other hand has two different arrays of 16 and 24 segments to depict the alphanumeric characters and the punctuation etc symbols, but the characters are all inclined at a 60° angle with respect to the horizontal.

Liquid crystal display systems known to applicant include Lapeyre U.S. Pat. No. 4,342,031 and Berman U.S. Pat. No. 4,235,526.

An object of this invention, accordingly, is to provide a display system, which is capable of a versatile display in a readily disernible form.

A further object of the invention is to provide a display means, which can selectively display numerical figures, alphabetical characters and other symbols in a readily discernible form with a comparatively small number of pattern elements.

Another object is to provide an alphanumeric display means that can be incorporated into a display system.

Yet another object is to provide a dispaly means comprising a novel array or matrix of light emitting or light reflecting elements.

A yet further object of the invention is to provide an array of light emitting or light reflecting elements for the display of the upper and lower case letters of the English language, the numerals and the punctuation marks and other symbols found in a typewriter keyboard.

Other objects of the invention will in part be obvious and will in part appear hereinafter.

The invention accordingly comprises the product possessing the features, properties and the relation of components which are exemplified in the following detailed disclosure, and the scope of the application of which will be indicated in the claims.

For a fuller understanding of the nature and objects of the invention, reference should be had to the following detailed description taken in conjunction with the accompanying drawings.

BRIEF DESCRIPTION OF THE FIGURES

FIG. 1 is a plan view of the dual vertical column display means showing the disposition of the array of light emitting or reflecting elements of this invention which on selective energization produce the alphanumeric and other typewriter characters according to his invention.

FIG. 2 is a plan view that diagrammatically depicts a plurality of arrays according to the invention which when selectively energized produce the numerals 0–9.

SUMMARY OF THE INVENTION

Figure 3A:
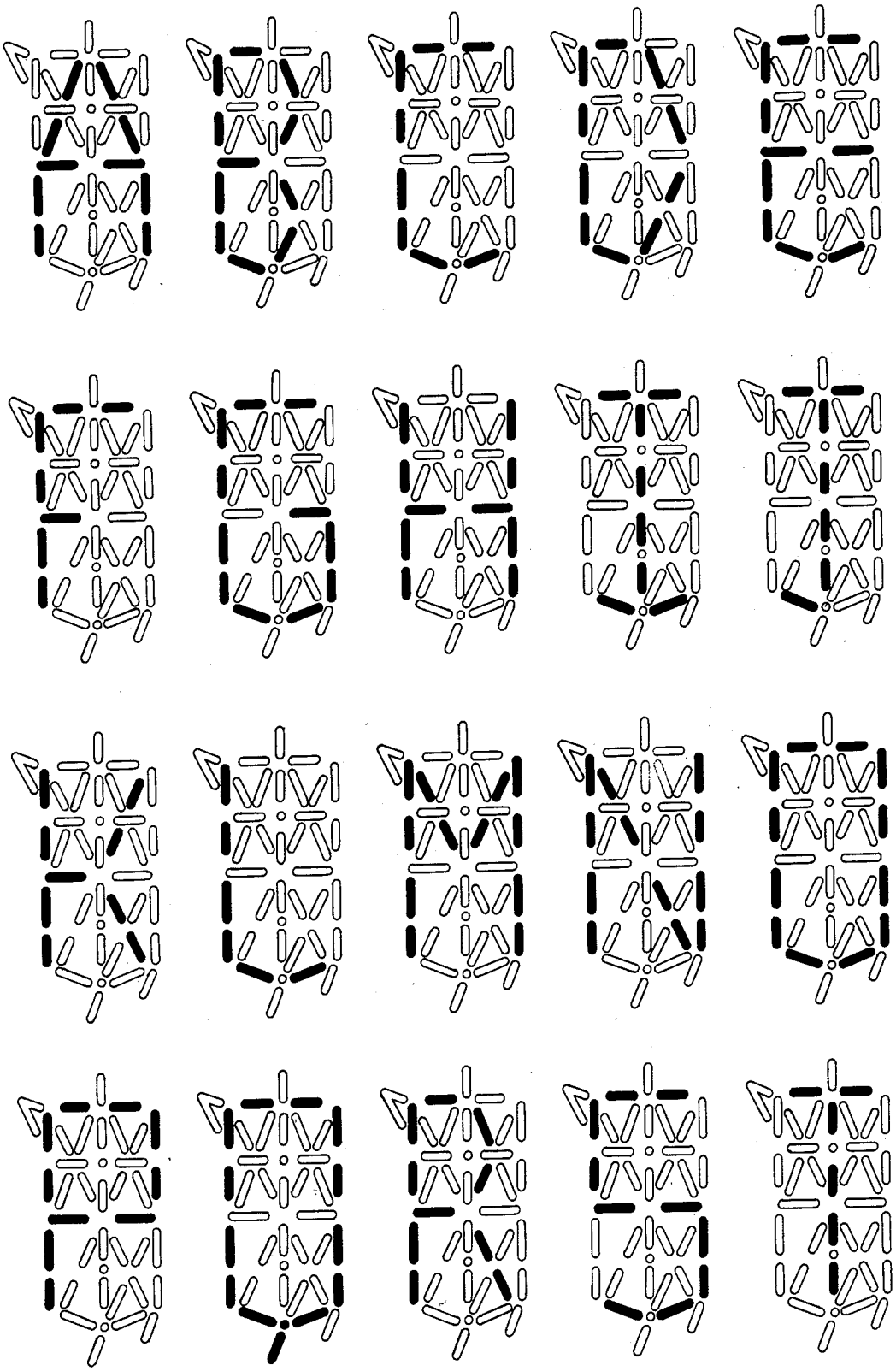
FIGS. 3A, 3B, and 3C are plan views similar to FIG. 2 that upon energization depicts the formation of all of the upper and lower case alphabet letters employing the display means of this invention.
Figure 3B:
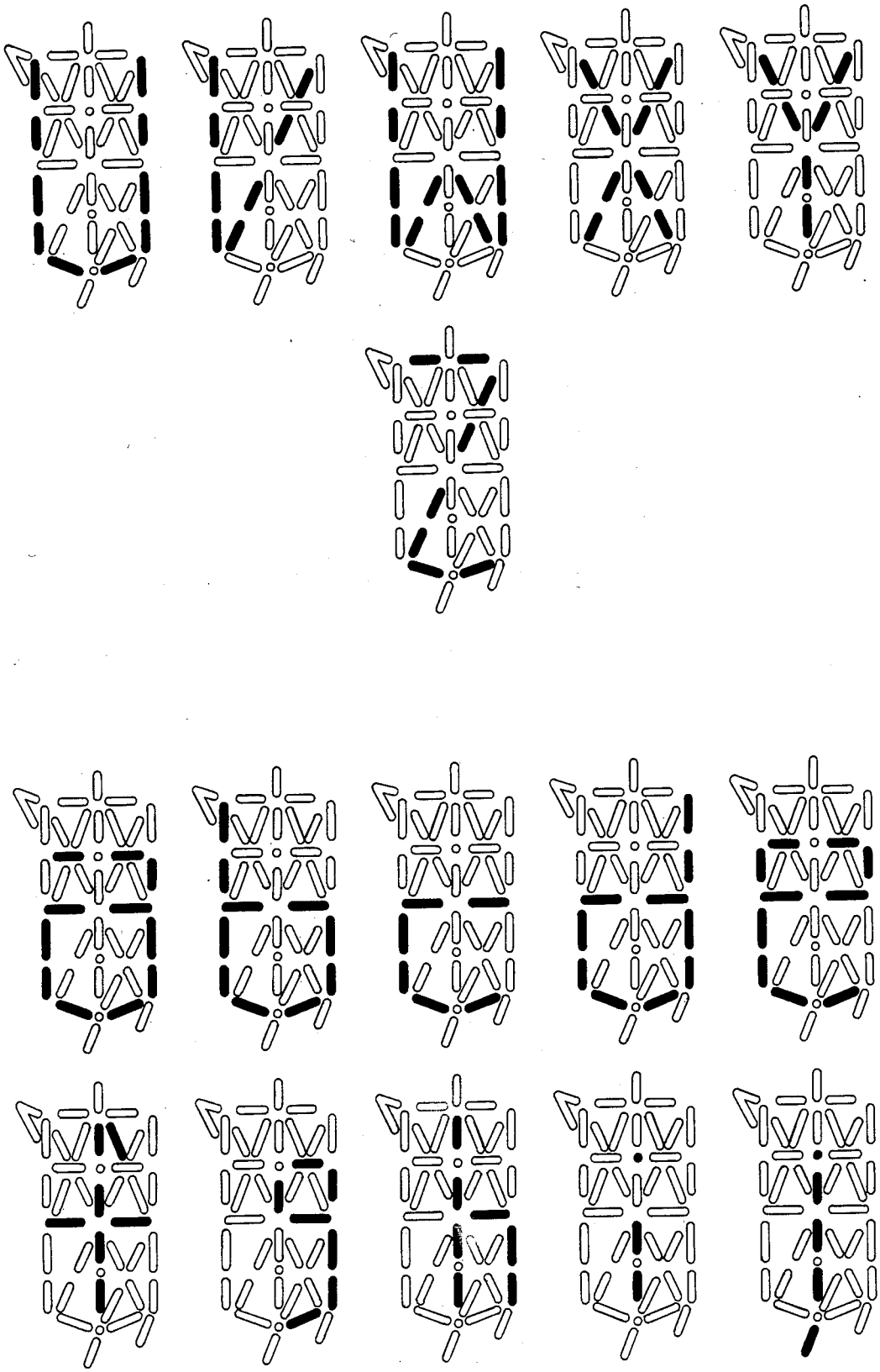
Figure 3C:
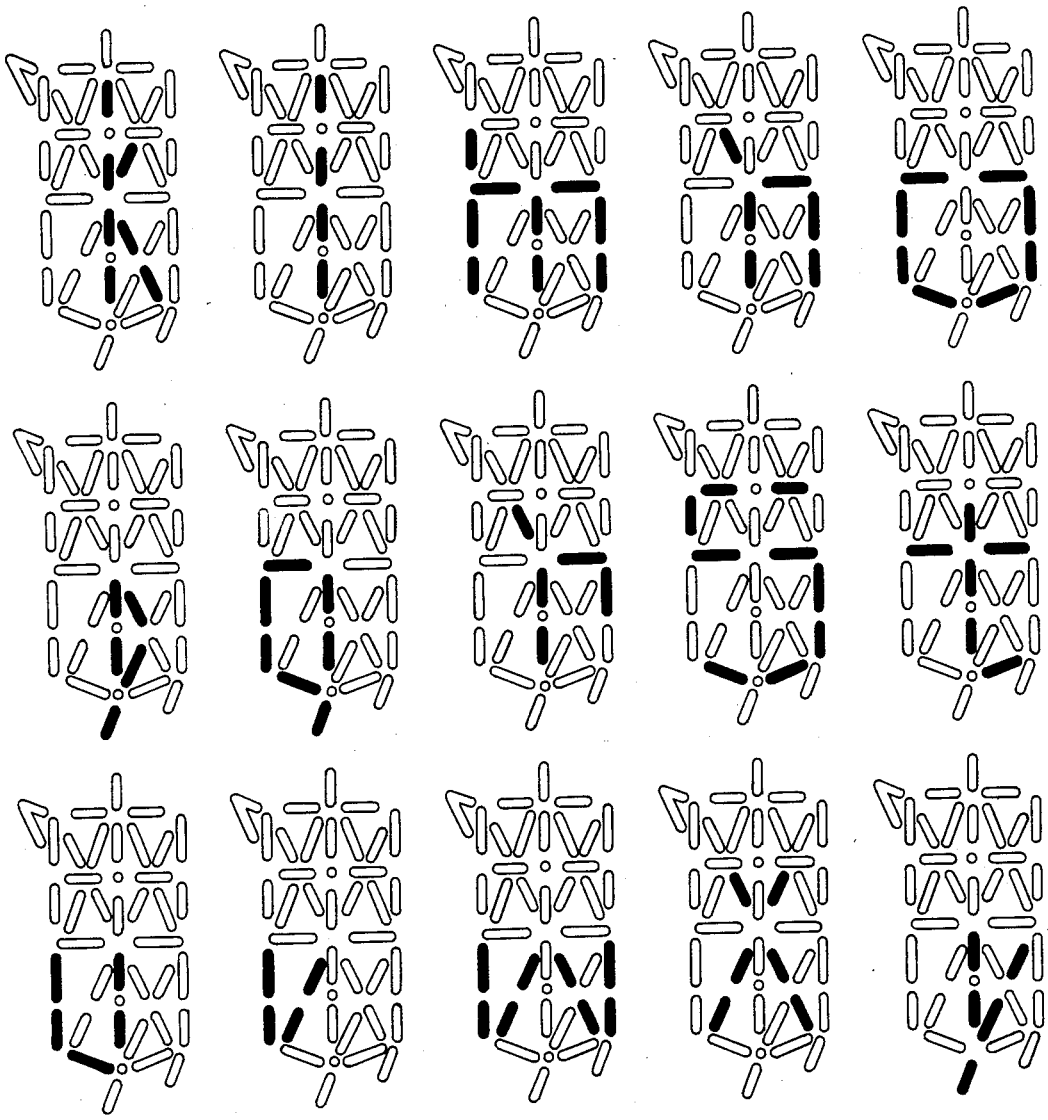
Figure 3C:
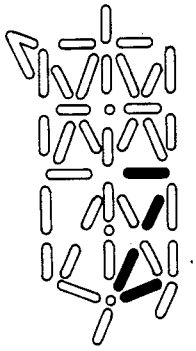

An alphanumeric display means wherein certain combinations of light reflective or light emitting elements can be selectively energized within a particular array to form the various letters and numbers and punctuation symbols of the English language.

Means for activating the display means of this invention is also recited.

DESCRIPTION OF THE PREFERRED EMBODIMENT

Reference is now made to FIG. 1 wherein the display means of this invention is shown in gross. As is seen the display 10 is comprised of 6 zones laid out in columns and rows. The vertical columns are designated 21 and 22, while the horizontal columns are designated 31, 32, and 33. The upper left zone would therefore be designated 2131 while the lower right zone is designated 2233.

The vertically oriented display is seen to be comprised of 42 elements, which are numbered 40–81 inclusive. Each individual light emitting or reflecting element is configured in any of 3 different shapes, namely a straight line which may be horizontally, vertically or angularly disposed, or a circular element.

The display includes six zones designated Z1–Z6 respectively. Each zone is generally rectangular, and includes an element that serves double duty as both a top member of a zone and as the bottom member of the adjacent zone; or as the side member of adjacent zones.

According to the invention, each alphanumeric array 20, of the plurality of zone based elements is formed from elements supported in a means such as frame 25 and arranged,—as seen by the viewer,—in horizontal rows and two vertical columns. As shown in FIG. 1, the upper row, the middle row, and the lower row of array 20 each contain a plurality of elements. Some of the middle row elements are seen to serve the dual function of being boundary elements for the upper or lower row with the middle row. The elements are arranged in a close relationship so as to form plural element columns in like fashion. Each row has two zones and each column has 3 zones for an overall total of 6 separate, but boundary overlapping zones.

The 6 zones are all contiguous and of substantially equal size. Thus the two uppermost horizontal segments 42, and 43 are axially aligned, but not the two lower most 77 and 79. Also the linear vertical boundary segments of adjacent zones are also axially aligned; e.g. 45, 55, 64 and 71, on one side and 51, 61, 69, and 76 on the opposite side.

Unlike prior systems wherein certain letters in either upper and/or lower case appear slanted, the letters numerals and other indicia appear correctly oriented in the display means of this invention.

As was indicated previously, there are 6 generally rectangular zones Z1–Z6 within the total display. In defining these it is readily seen that segments 52, 54, 62 and 63 form the borders for two adjacent vertically oriented zones, namely Z1, and Z2 and Z3 respectively. While segments 48, 58, 66, and 73 together; all serve as dividers between adjacent horizontally disposed zones. Disposed supra the first and fourth zones is a single vertically disposed element 40, axially aligned with the vertical bifurcator formed of the elements 48, 58, 66 and 73 as discussed above.

The upper left zone includes a pair of spaced horizontal elements 42, and 52 and a pair of spaced vertical elements 45 and 48. Element 46 is of a first length and is disposed downwardly to the right and spaced from the gap between elements 45 and 42; while element 47 is of a second longer length and is disposed downwardly and leftwardly from the gap between 42 and 48. Element 47 is also spaced from the lower end of 46 and from 52 as well.

Disposed spaced from but adjacent 45 is a mirror image 7 formed of the junction of downwardly and rightwardly disposed element 44 and the slightly angled upwardly to the left element 41 connected thereto.

Zone 4 is substantially similarly configured as zone 1 just described in that it is generally rectangular, but does not include the pendent mirror image 7. Thus there are seen spaced horizontal elements 43 and 54 and the boundary vertical element 48 on the left spaced from vertical element 51. Disposed within the rectangle just described is a pair of spaced elements 49, 50 of the second length, that are disposed in a generally V shaped configuration.

Equidistant from each of 52, 54, and 48 and its aligned next adjacent member 58 is a round element 53. This element serves as the lower right corner for zone 1 and the lower left corner for zone 4., as well as the corner for each of zones 2 and 5.

Zone 2 is defined by spaced horizontal elements 52 and 62, and spaced vertical elements 55 and 58. Contained therein are the two downwardly and oppositely diverging elements 56 and 57. Element 56 of the second length depends leftward, while the element 57 is of the first length depends rightward.

Zone 5 is defined by the spaced horizontal elements 54 and 63, as well as the spaced vertical elements 58 and 61. Spaced from 54 as in like manner 56 and 57 are spaced in zone 2, are downwardly and appositely depending segments 59, of the first length and 65 of the second length. These diverging elements do not intersect any of the box forming elements 54, 58, 61 or 63. Note also the mirror image element disposition of 59 and 65 versus 57 and 56. Reference is made to FIG. 1.

Zone 3 and zone 6 are seen to be larger rectangular zones than the previously discussed zones in that each includes a pair of aligned vertical elements on each side, and in the boundary therebetween. Thus zone 3 includes a pair of vertically spaced from each other elements 64 and 71, uniformly spaced horizontally from boundary elements 66 and 73 respectively. Its top element 62, shared with zone 2 is spaced from bottom element 77. Angularly disposed from upper right to lower left, and linearly aligned but spaced from each other and spaced each from its adjacent zonal corner are elements 65 and 72.

Whereas element 64 is of the second length and 71 of the first length; 66 and 73 are both of the shorter second length. Interposed between these two least elements is a circular element 70. Another circular element 78 is disposed in line with 73, but spaced from it and horizontal element 77 at the at the zonal lower right corner.

Zone 6 has a top element 63 spaced from its bottom element 79. The sides of the rectangular zone are formed on the left by the aforementioned vertically aligned 66, 70, 73 and 78; while the right side is comprised of aligned and vertically spaced 69 and 76. Disposed with the confines of the rectangle is an X configuration of 4 elements, the upper two being 67, 68 and the lower two being 74, 75. All four of these X-forming elements are of the first size.

Disposed beneath zone 6 are a pair of parallel angularly disposed downwardly and leftwardly, and horizontally spaced size one linear elements 80 and 81. Element 80 is spaced from the lower right zonal corner of zone 6 and 81 is spaced from the lower left zonal corner of zone 6. All elements not specifically described as to configuration are linear elements.

Display 10 is capable of generating all of the numerals as illustrated plus all of the upper and lower case alphabet characters, mathematical and punctuation symbols. All of the numerals for example can be formed by energizing selected ones of the light emitting elements. For example, the numeral 1 is formed by energizing elements numbered 47, 48, 58, 66, 73, 77, 78, and 79.

The zero, as can be seen by reference to FIG. 2 which illustrates the selective energization of the numerals 0 through 9 inclusive, is formed from elements 42, 43, 51, 61, 69, 76, 79, 77, 71, 64, 55, and 45.

As mentioned previously all of the alphabetical letters, both upper case and lower case can be created by selective illumination or energization or specific elements within the array. Thus the letter capital B is formed by energizing elements 46, 49, 59, 67, 74, 77, 71, 64, 62, 55 and 45. While a capital J is formed by energizing elements 42, 43, 48, 58, 66, 73 and 77.

Small or lower case letter such as "c", are formed from elements 63, 62, 64, 71, 77 and 79 and the "d" is formed from the energization of elements 51, 61, 69, 76, 79, 77, 71, 64, 62 and 63. Reference is made to FIG. 3.

Figure 4A:
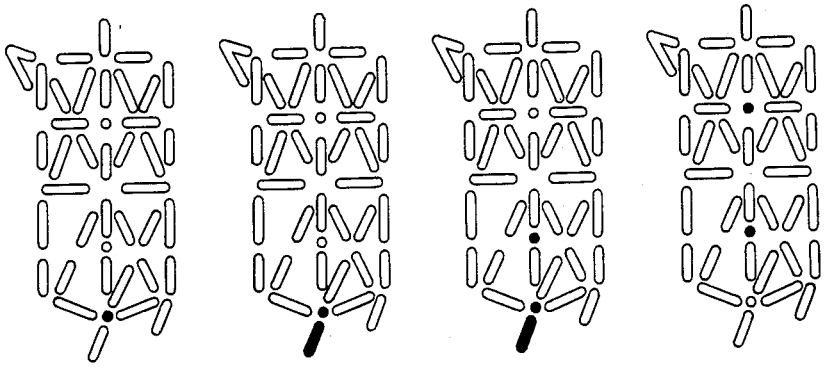
FIGS. 4A, 4B and 4C are views similar to FIG. 3 illustrating various miscellaneous symbols found on a typewriter or computer keyboard.
Figure 4B:
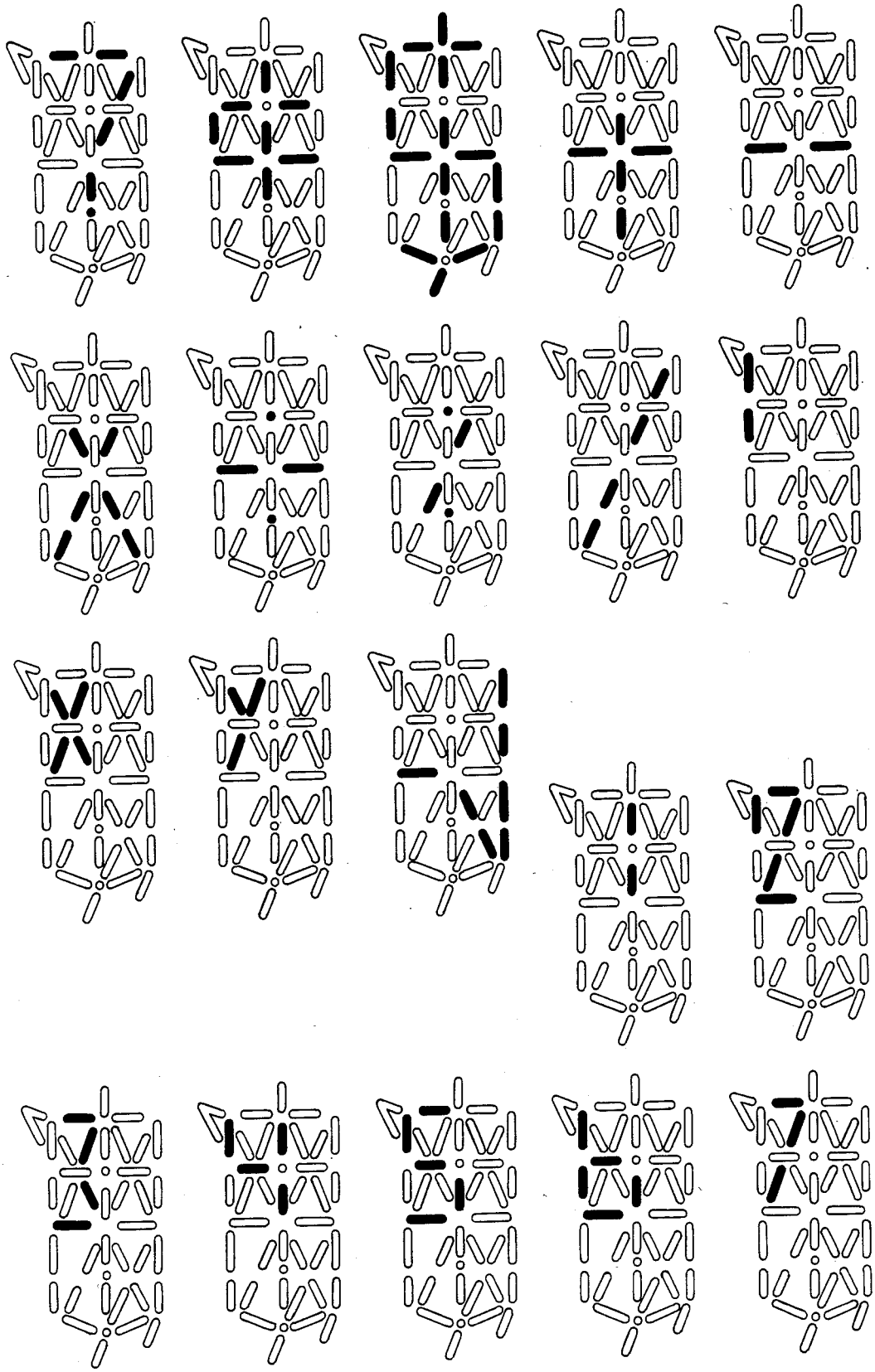
Figure 4C:
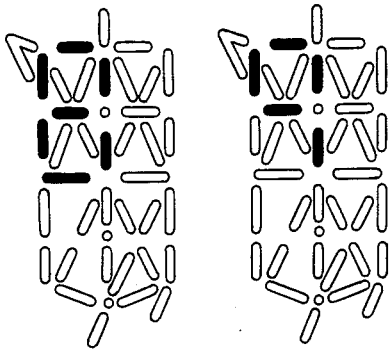

FIG. 4 illustrates several of the total of all of the numerical symbols and the punctuation symbols such as the numeral 4 which is formed by energizing elements 45, 55, 62, 63, 51, 61, 69 and 76 of the array, whereas when the 4 is desired to be an exponent (power) then elements 45, 52, 48 and 58 are to be energized. FIG. 4 also shows the typical punctuation symbols, namely the period, which is depicted in element 78, while the explanation point is formed from elements 48, 58, 66, and 73 in conjunction with 78.

Figure 5:
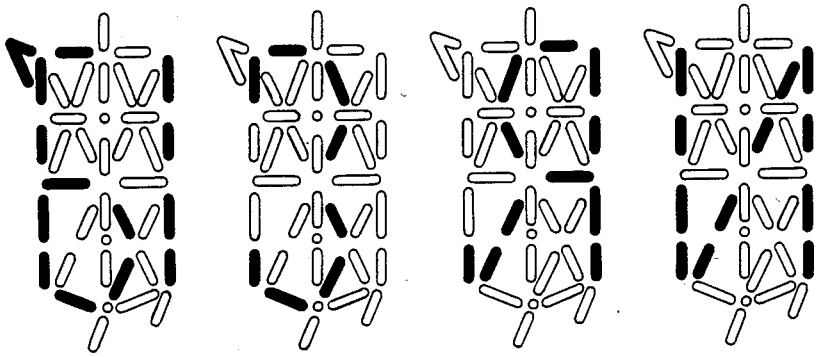
FIG. 5 is a plan view of the array of this invention depicting selective energization of individual elements in the format of 4 Russian alphabet letters.

FIG. 5 illustrates the fact that the letters of the Russian alphabet can also be displayed by selective energization of this array. Here the letters, Be, "G", Zhi, and cho of the total of 30 (plus alternative) letters in the Russian alphabet are illustrated. These typical ones are shown rather than the entire alphabet for the sake of brevity. All can be displayed however. Thus the Be is illuminated by the combination of 42, 44, 45, 55, 62, 64, 71, 77, 74, 76, 67, 69, 61, and 51. The G is formed from the following: 45, 42, 49, 59, 67, 74, 77, and 71. The zhi is made from 43, 47, 57, 65, 72, 71, 76, 69, 63, 61, and 51. The cho is formed from elements 45, 55 64, 71 72, 65, 59, 50, 51, 61, 69, and 76.

The alphanumeric array of light-emitting and light reflecting elements of this invention is readily adapted for use in today's "hi tech" world of computers; camera, scientific instruments and other innovative products that require a rapid response read out of indicia. Light emitting diodes and the newer generation of liquid crystals may be employed herein as typical sources of light emitting and light reflecting elements. The light emitting diodes. LEDs are especially useful as they are available in various colors, and require only very small operating currents.

Figure 6:
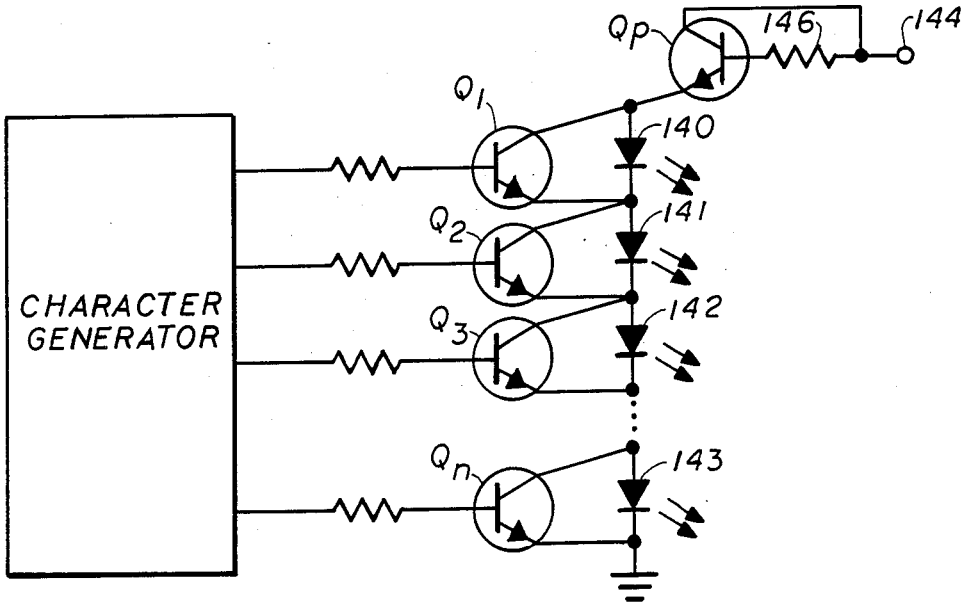
FIG. 6 is a schematic diagram of a solid state alphanumeric display system including the means for energizing selected elements.

FIG. 6 is illustrative of one of a host of circuits that can be employed for the energization of the array of this invention. Such a circuit includes a plurality of segments, such as LEDs connected in series with one another and to the emitter of transistor $Q_p$ which serves as a constant current supply. The collector of this transistor is connected to a terminal 144 at which a suitable voltage is applied, and its base is connected to the collector through a resistor, 146. Switching of each diode as required for a particular symbol or character is achieved by connecting across each diode a transistor which when turned on, functions as a shunt for turning off the particular light-emitting diode.

The collector-emitter circuits of transistors designated $Q_1$, $Q_2$, $Q_3$, . . . $Q_n$ are connected, respectively, across light-emitting diodes 140, 141, 142, and 143 and the bases of the transistors are coupled to character generators such as a group of current sources activated manually, or by computer, or in accordance with the output of an encoder or decoder which will provide the requisite character signals. The character generator provides signals that serve to turn on the transistors controlling those diodes that are not required for a specific character display. Thus, for example, when employing the array shown in FIG. 1, the number 4 is formed when light-emitting diodes corresponding to the elements previously enumerated are activated and the transistors controlling the other elements are turned on thereby preventing energization of the corresponding remaining diodes.

In the text above above, the subscript "n" stands for a finite number equal to the number of elements in the array.

While the circuitry shown produces a static display, other circuitry may be employed, the design of which within the skill of the art, to produce dynamic displays in which the emitter (LED's) are energized in rapid sequence. Dynamic strobing may have advantages in a number of applications, particularly in simplifying the interfacing of the display with a computer.

It will be apparent from the foregoing that the array of elements of this invention provides easily legible and aesthetically pleasing alphanumeric characters and of the symbols employed in punctuation and mathematics. A plurality of the arrays can be arranged in adjacent relation to provide for a visual display of multiple digit numbers, words, multiple word messages, mathematical and chemical equations, and the like. Individual arrays can be of varying sizes as required in the same group thereof. Languages other than English and Russian, for instance German can be displayed in the array of this invention.

It is to be noted that elements 41 and 44 can also be combined into a single element since, when utilized both elements would be energized together to form a serif, thus reducing the number of elements from 42 to 41.

Since certain changes may be made in the above device without departing from the scope of the invention herein involved it is intended that all matter contained in the above description or shown in the accompanying drawings shall be interpreted as illustrative and not in a limiting manner.

I claim:

1. An alphanumeric display system for displaying the Russian and English languates comprising in combination;

an array of 42 electrically energizeable elements, which elements are arranged in a generally vertically oriented rectangular array with appendages thereto, said array consisting of six generally rectangular zones arranged in two equal vertical columns of said zones, said array's six zones each having spaced horizontal and spaced vertical boundary elements, and said array's six zones each having at least one linear, angularly disposed element within each zone, said array being energizable in selected combinations to form all of the numerals, letters and other symbols of said languages.

2. The display system of claim 1 wherein the six zones are designated upper left, upper right, middle left, middle right, lower left and lower right.

3. The display as in claim 1 wherein the plurality of elements include elements some of which are linear and others of which are circular.

4. The display as in claim 1 wherein the elements include linearly configured elements, some of which are disposed generally horizontally and some of which are disposed generally vertically.

5. The display of claim 1 wherein the symbols include both mathematical and punctuation symbols.

6. A display system as defined in claim 1 further including means for energizing selected combinations of the elements to form numerals, letters, and other symbols.

7. The display system of claim 1 wherein a plurality of at least two of the arrays are disposed adjacent to each other to permit the formation of words and multi digit numerals.

8. The display system of claim 7 further including means for energizing selected combinations of the elements to form numerals, letters and other symbols.

9. The display system of claim 1 wherein one element is a vertical linear element spaced above the center line between the right column and left column of the display.

10. The display system of claim 1 wherein the display includes a pair of parallel elements inclined downwardly and leftwardly, spaced from the lower right corner of the display, and from the midpoint along the bottom of the display respectively.

11. An alphanumeric display system for displaying the Russian and English languages comprising in combination;

an array of 42 electrically energizeable elements, which elements are arranged in a generally vertically oriented rectangular array with appendages thereto, which array consists of six generally rectangular zones arranged in two equal vertical columns of said zones, namely a left column and a right column, with a center line therebetween, said array's six zones each having spaced horizontal and spaced vertical boundary elements, and said array's six zones each having at least one linear, angularly disposed element within each zone, further including as an appendage to the rectangular array a vertical linear element spaced above the center line between the right column and left column of the display, and also as appendages a pair of parallel elements inclined downwardly and leftwardly, spaced from the lower right corner of the display, and from the midpoint along the bottom of the display respectively, said array and appendages being energizable in selected combinations to form all of the numerals, letters, and other symbols of said languages.

* * * * *